US007765610B2

(12) United States Patent
Lerma

(10) Patent No.: US 7,765,610 B2
(45) Date of Patent: Aug. 3, 2010

(54) ATHLETIC PROTECTIVE DEVICE

(76) Inventor: Chad Lerma, 82678 Elkwood Mountain Rd., Cannon Beach, OR (US) 97110

( * ) Notice: Subject to any disclaimer, the term of this patent is extended or adjusted under 35 U.S.C. 154(b) by 0 days.

(21) Appl. No.: 11/968,452

(22) Filed: Jan. 2, 2008

(65) Prior Publication Data

US 2009/0171260 A1 Jul. 2, 2009

(51) Int. Cl.
*A61F 13/00* (2006.01)

(52) U.S. Cl. ..... 2/72; 602/67; 128/846

(58) Field of Classification Search ..... 602/67–73; 128/846, 845, 891, 95.1; 2/466, 400, 403, 2/404, 406, 407, 23
See application file for complete search history.

(56) References Cited

U.S. PATENT DOCUMENTS 2,283,684 A * 5/1942 Matthews ..... 602/72
4,257,414 A 3/1981 Gamm et al.
4,453,541 A 6/1984 Castelli et al.
D391,386 S 3/1998 Sinclair
6,319,219 B1 11/2001 Landi
6,334,223 B1 1/2002 Pieri
7,004,921 B2 2/2006 Littell
7,178,176 B1 2/2007 S-Cronenbold
7,296,307 B2 * 11/2007 Atwater et al. ..... 2/466

OTHER PUBLICATIONS

"International Search Report and Written Opinion", International Application No. PCT/US2008/088686, mailed Jun. 25, 2009, 10 pages.

* cited by examiner

*Primary Examiner*—Kim M Lewis
(74) *Attorney, Agent, or Firm*—Blakely, Sokoloff, Taylor & Zafman, LLP

(57) ABSTRACT

Embodiments of the invention relate to an athletic cup to direct forces away from soft tissue. In an embodiment, the athletic cup has a convex structure to direct a force associated with an impact to the athletic cup to a pelvic bone of a wearer and away from soft tissue of the wearer. In one embodiment, the athletic cup directs the force of an impact away from a penis, a scrotum, and a perineum of a wearer.

17 Claims, 3 Drawing Sheets

ATHLETIC PROTECTIVE DEVICE

FIELD

Embodiments of the invention relate generally to the field of athletic protective devices and more particularly, to an athletic protective device to protect the male genitalia including the nerves associated with the penis and male perinea.

BACKGROUND

Athletic protective equipment is commonplace in many sports. Athletic protective equipment may be unique to a particular sport, such as a mountaineer's Tibloc Ascender or ice pick, while other equipment is common across many athletic disciplines, for example, helmets, knee braces, and athletic cups.

Prior art athletic cups are familiar to the art of athletic equipment, designed to protect a male's genitalia, including the penis and testes. Such devices are widely used and are especially commonplace in contact sports having a heightened likelihood of sustaining a damaging impact to a male athlete's genitals. Such sports include for example, American football, rugby, soccer (e.g. International football), boxing, martial arts, and many others.

Prior art athletic cups attempt to protect the male genitalia by covering the penis and scrotum with a rigid convex shaped "cup" structure allowing free movement of the penis and scrotum while offering them protection in the event of an impact. Upon impact to a person wearing a prior art athletic cup, the rigid convex shaped structure resists collapse, thus protecting the penis and scrotum from impact, and directs the force of the impact to the portions of the cup in contact with the athlete's body. More particularly, the force of the impact is intended to be spared by the penis and scrotum as the outermost point of the convex shaped rigid structure remains spatially separated from the penis and scrotum. The force is instead felt by the athlete along the surrounding edge of the athletic cup. To distribute the force evenly, this surrounding edge typically is in contact with an athlete's body in an arc shape above the penis curving down along each side of the penis and scrotum, continuing along the upper inner thighs, and then under the pelvic bone posterior to the scrotum and anterior to the anus.

A wearer of a prior art athletic cup therefore, upon impact to the athletic cup will experience the full force of the impact distributed away from the penis and scrotum and onto the areas of the body in contact with a surrounding edge of the prior art athletic cup including above and next to the penis, and behind the scrotum.

An improved athletic cup as disclosed herein may aid in the prevention of injuries associated with impact to the male groin area inadequately protected by prior art devices.

SUMMARY

Embodiments of the invention relate to an athletic cup to direct forces away from soft tissue in the groin and pelvic area. In an embodiment, the athletic cup has a convex structure to direct a force associated with an impact to the athletic cup to a pelvic bone of a wearer and away from soft tissue of the wearer. In one embodiment, the athletic cup directs the force of an impact away from a penis, a scrotum, and a perineum of a wearer.

Other features and advantages of embodiments of the present invention will be apparent from the accompanying drawings, and from the detailed description, that follows below.

BRIEF DESCRIPTION OF THE DRAWINGS

The invention may be best understood by referring to the following description and accompanying drawings that are used to illustrate embodiments of the invention.

DETAILED DESCRIPTION

Figure 1A:
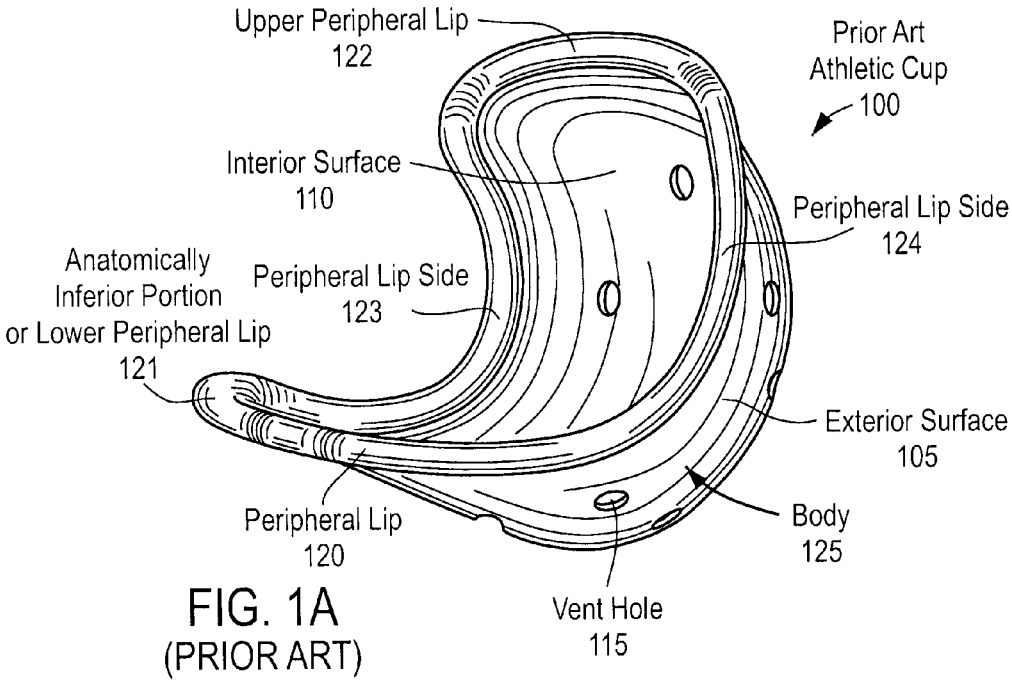
FIG. 1A (PRIOR ART)
FIGS. 1A and 1B illustrate a prior art athletic protective device, in particular, a prior art athletic cup from two distinct viewing angles depicting a lower edge portion that rests on or above a perineum of a wearer.

Males engaged in a variety of athletic and physical activities commonly wear an assortment of devices to protect their bodies from sustaining damage as a result of the physical activities, or to minimize damage resulting from the activities. Some athletic disciplines are especially susceptible to serious injury resulting from impact associated with the nature of the sport in which they are engaged.

American football players for example wear protective helmets to protect against head injuries, large shoulder pads to protect against back, clavicle, and shoulder related injuries, and athletic cups to protect against soft tissue injury in the groin and pelvic areas. Similarly, International football (e.g. American soccer) players wear thick shin guards to protect against powerful shin to shin impacts to their legs, and wear athletic cups to protect against soft tissue injuries resulting from impacts to their groin.

The athletic cup, or "cup" as it is sometimes called, is in fact common to a large variety of sports including football, soccer, rugby, ice hockey, basketball, baseball, martial arts, and many others. Medical professionals and athletic organizations term these sports "contact" sports because there is a certainty of physical contact between athletes. These contacts, sometimes referred to as "collisions," are a key source of injury, and thus a target for safety equipment such as athletic cups.

In some sports, such as basketball, football, soccer, and ice hockey, collisions between players are inevitable, but are also incidental to the aims of the game. For example, in American football, players of opposing teams "tackle" or "block" one another by physically impeding the progression of the other player in an attempt to strategically benefit their team's chances of scoring game points or to aid their team in defending against point scoring by the opposing team. The physical contact is not for the sole purpose of incapacitation. In other sports however, such as boxing and martial arts, contacts and collisions are intentionally exchanged between participants in an effort to render the opposing athlete incapable of continuing their participation. For example, in boxing, the opponent's ultimate goal is to secure a victory by way of "knock out," which is to render an opponent temporarily unconscious or incapacitated. A victory in mixed martial arts may be secured by rendering the opponent incapable of defending themselves, by knockout similar to boxing, or by "submission" (e.g. giving up) by one participant. Sports involving the intentional exchange of physical contact between participants are sometimes referred to as "full-contact" sports. Examples of full-contact sports include boxing, full-contact karate, mixed martial arts, and kickboxing.

The human body protects most of its organs via hard skeletal bones. For example, the brain is protected by the skull and the heart is protected by the rib cage. Other organs of the human body (e.g. the bladder) reside inside of the pelvic cavity and are protected by the pelvic bone. A male's body however has organs exterior to it, unprotected by the skeleton. In particular, reproductive organs called testes or testicles reside outside of the body protected only by a scrotal sac in the groin area. The male penis likewise resides in the groin area unprotected by skeletal bones.

The possibility of receiving a kick or other damaging impact to the groin is possible in all contact sports, and is especially pronounced in full-contact sports. These damaging impacts may be intentional or unintentional, but have a strong possibility of resulting in a painful and possibly severe soft-tissue injury. A soft tissue injury in the groin area of a male or female can result in injury ranging from temporary bruising and swelling to permanent and more severe injuries. Soft tissue groin injuries associated with males in particular include injuries to the soft tissues including the penis (e.g. the penile bulb, penile base, and penile structures), the scrotum (e.g. the testes, scrotal sac, and scrotal structures), and the perineum (e.g. perineal artery, nerves, and veins).

A serious impact or blunt trauma to the testes may result in testicular torsion or testicular rupture. In the case of testicular torsion, the testicle twists around, cutting off its blood supply. Testicular torsion can result in reduced sperm production or the loss of an affected testicle. Testicular rupture can occur when a testicle receives a forceful blow and is crushed against the pubic bone. Such a rupture can cause blood to leak into the scrotal sac resulting in extreme pain, swelling inside of the scrotum, nausea, and vomiting, often requiring surgical intervention.

An impact to a male perineum, sometimes called a "saddle impact," can likewise result in soft tissue injuries ranging from discomfort and bruising, to permanent nerve damage resulting in numbness in and around the penis, erectile dysfunction, and urethra damage resulting in urinary tract problems. The male perineum is an area of the body located between the scrotal sac and the anus, the female perineum is similarly situated between the anus and the fourchette of the vulva.

The perineum is especially sensitive as it contains a large number of nerve endings, many of which are associated with the human genitalia, and thus are also associated with important aspects of human sexual stimulation. Soft tissue blunt trauma injuries (e.g. saddle injuries), are known to occur frequently among bicyclists as a result of their sitting position on bike seats. In particular, bicyclists must position themselves with a bike seat between their legs with the foremost portion of the bike seat immediately beneath the perineum. As the bicyclist leans forward to grasp a bicycle's handle bars, additional weight of the rider is shifted onto the perineum and off of the buttocks. Long durations of pressure on the perineum in this manner can lead to discomfort, bruising, and eventually numbness and erectile dysfunction. An impact or blunt trauma while sitting in this position can result from a jolt to the bike, such as riding over a bump that transfers its force through the bike frame, into the bike seat, and into the perineum of the rider.

Injury may also be sustained from non-impact forces and blunt traumas. For example, repetitive or prolonged micro-trauma to the perineal area of a wearer can lead to irritation, sensitivity, or numbness of the wearer's perineum and structures associated with the perineal area. Similarly, Continuous pressure exerted onto or into the perineal area of a wearer, for example from a firm protruding end of an athletic cup positioned over the perineum, can cause injury over time, even without the occurrence of any blunt trauma or impact to the perineum or the athletic cup.

Figure 1B:
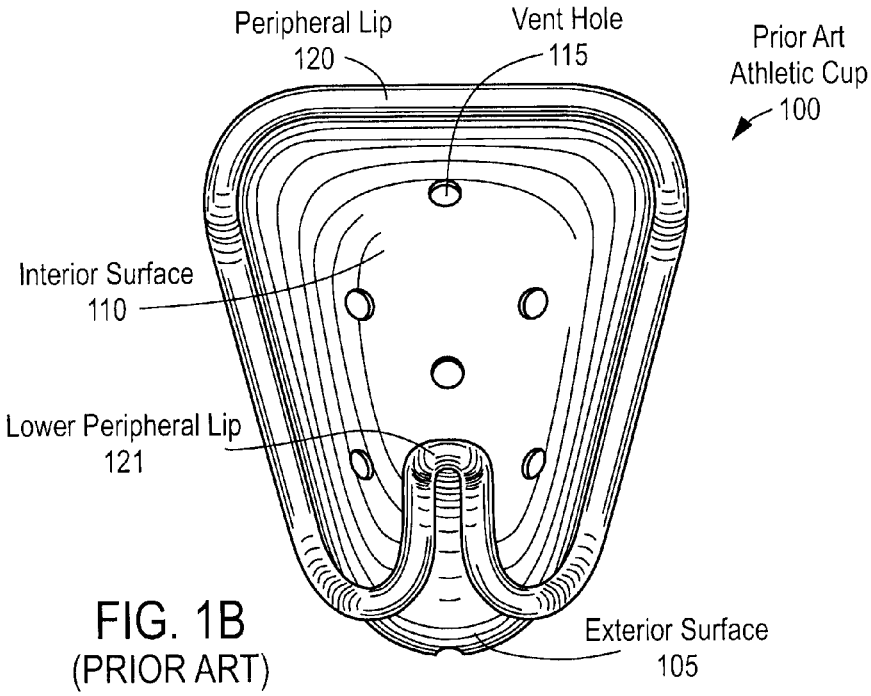
FIG. 1B (PRIOR ART)

Refer now to FIGS. 1A and 1B illustrating a prior art athletic protective device, in particular, a prior art athletic cup 100 depicting a lower edge portion that rests on or above a perineum of a wearer. FIGS. 1A and 1B depict a single prior art athletic cup 100 from two distinct viewing angles merely to aid in understanding. Prior art athletic cup 100 has exterior surface 105, interior surface 110, vent holes 115, and peripheral lip 120 encompassing the entire circumference of prior art athletic cup 100. Exterior surface 105 and interior surface 110 make up body 125 of prior art athletic cup 100.

Prior art athletic cup 100 is designed to be worn by male athletes, typically inside of a jock strap, which holds the prior art athletic cup 100 in position. Prior art athletic cup 100 is positioned with the peripheral lip 120 resting against the skin of a wearer. Upper peripheral lip 122 rests on a wearer's skin above the penis, peripheral lip sides 123 and 124 rest on the wearer's skin on either side of the penis and scrotum, and lower peripheral lip 121 or the anatomically inferior portion (121) of prior art athletic cup 100 rests beneath or behind the scrotum on the perineum. Peripheral lip elements 121-124 all constitute unbroken parts of the same peripheral lip 120, and are identified as segments only for the sake of understanding and placement on a wearer.

Prior art athletic cup 100 is designed to prevent interior surface 110 from crushing a wearer's penis and testicles upon receipt of an impact to body 125. Prior art athletic cups 100 come in varying rigidity, sometimes called "hard cups" and "soft cups," that trade comfort for protection. More rigid prior art athletic cups 100 offer a greater protection against injury to a wearer's penis and testicles, but may be less comfortable to wear.

Prior art athletic cups 100 work by transferring forces associated with an impact to exterior surface 105 through their rigid or semi-rigid body 125 into peripheral lip 120 and into areas of the wearer's body upon which peripheral lip 120 rests, notably the pelvic bone and the perineum. The force of the impact is thus deflected away from the wearer's penis and testes, each highly susceptible soft tissue, thus greatly reducing the risk of injury to the penis and testes.

A portion of the force received by prior art athletic cup 100 is transferred to the pelvic bone through the wearer's skin in contact with the upper peripheral lip 122 and peripheral lip sides 123-124. The pelvic bone is better suited to receive this force than the penis, the scrotum, or the scrotum's testicles. The remaining portion of force received by prior art athletic cup 100 is transferred into the perineum through lower peripheral lip 121. As discussed above, this blunt trauma impact resulting from the forces incurred at exterior surface 105 and body 125 can cause discomfort and with a severe enough impact (e.g. a missed kick by a soccer player, or a blow from a martial arts fighter), serious injury to the perineum can occur.

In accordance with an embodiment of the present invention, disclosed is an athletic cup to direct impact forces away from soft tissue. In an embodiment, the athletic cup has a convex structure to direct a force associated with an impact to the athletic cup to a pelvic bone of a wearer and away from soft tissue of the wearer. In one embodiment, the athletic cup directs the force of an impact away from a penis, a scrotum, and a perineum of a wearer.

Reference throughout the specification to "one embodiment," "an embodiment," or "another embodiment," means that a particular feature, structure, or characteristic described in connection with the embodiment is included in at least one embodiment of the present invention. Thus, the appearance of the phrases "in one embodiment," "in an embodiment," or "in another embodiment," in various places throughout the specification is not necessarily referring to the same embodiment, but may be. Furthermore, the particular features, structures, or characteristics may be combined in any suitable manner in one or more embodiments.

Moreover, inventive aspects lie in less than all features of a single disclosed embodiment. Thus, the claims following the Detailed Description are hereby expressly incorporated into this Detailed Description, with each claim standing on its own as a separate embodiment of this invention.

Figure 2A:
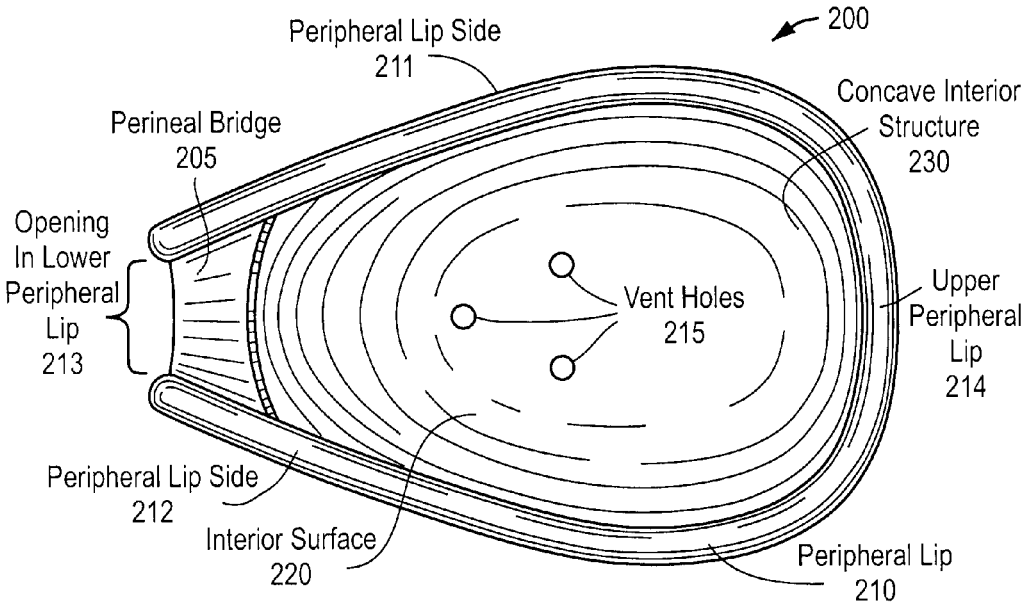
FIGS. 2A, 2B, 2C, and 2D illustrate an athletic cup from a variety of angles including: viewing an athletic cup looking straight up from beneath in FIG. 2A; viewing the athletic cup looking straight down from above in FIG. 2B; viewing the athletic cup straight on from an equal plane with a perineal bridge in the foreground in FIG. 2C; and viewing the athletic cup looking straight at one side from an equal plane with a peripheral lip side in the foreground in FIG. 2D.
Figure 2B:
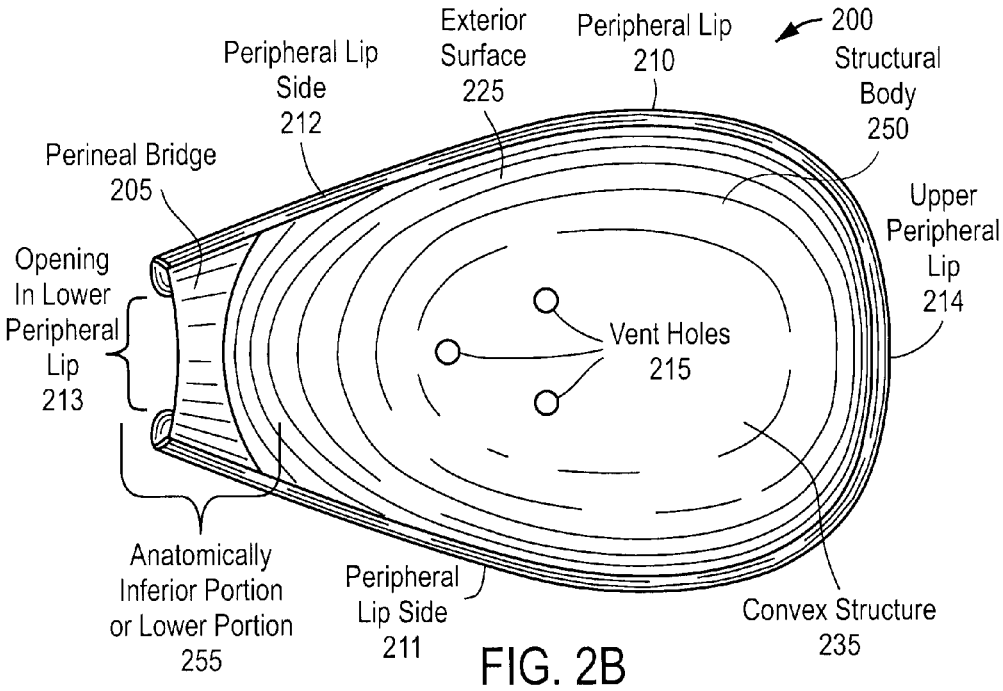
Figure 2C:
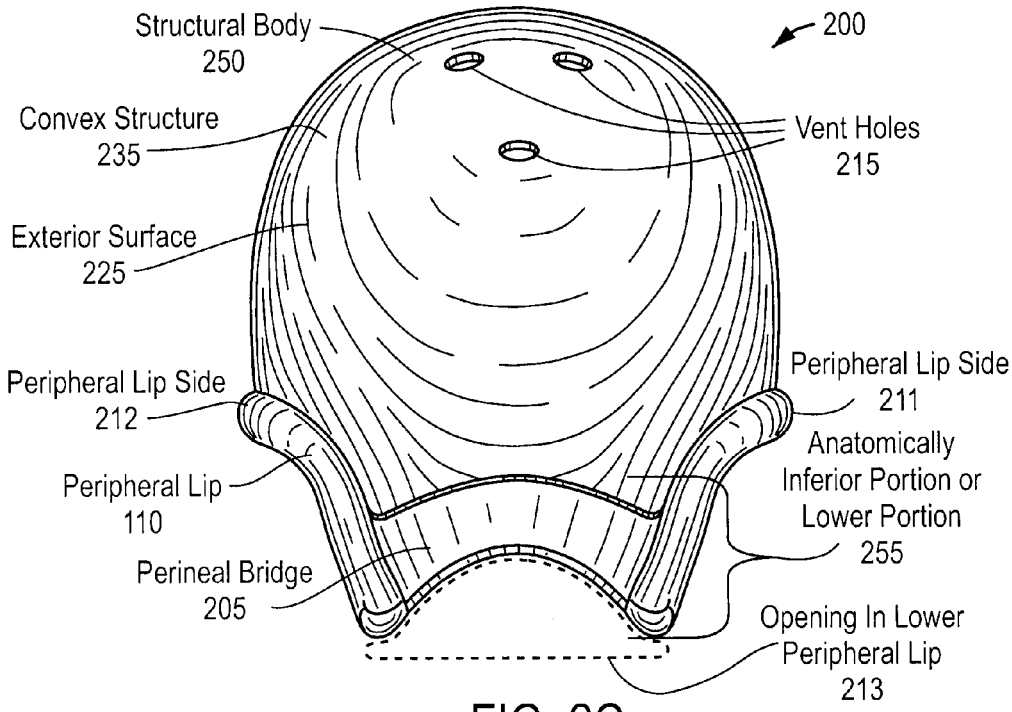
Figure 2D:
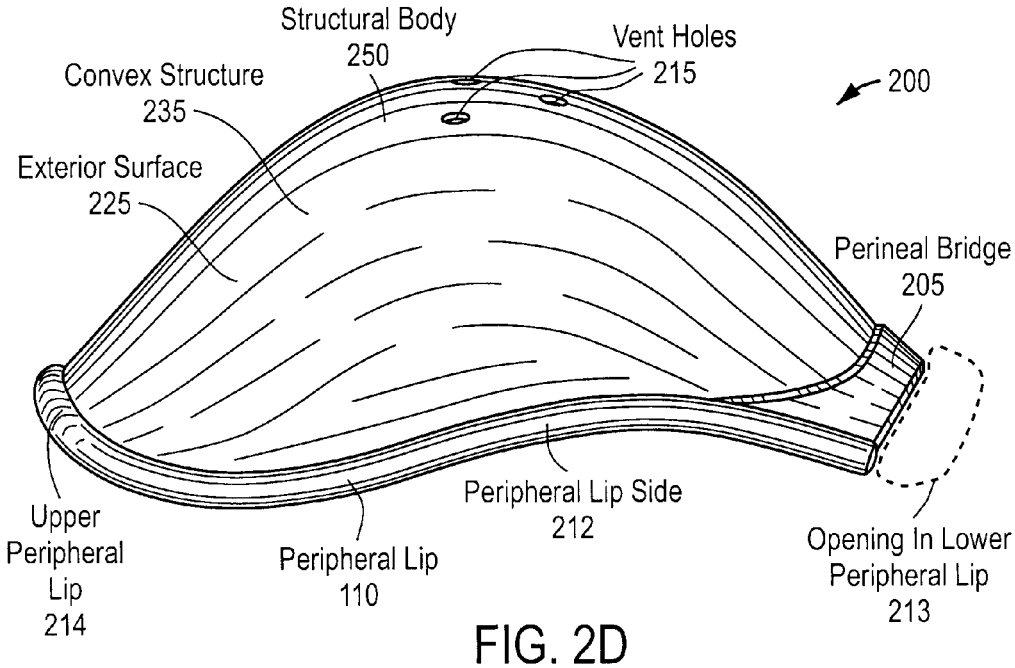

Refer now to FIGS. 2A, 2B, 2C, and 2D illustrating an athletic cup 200 from a variety of angles including: viewing athletic cup 200 looking straight up from beneath in FIG. 2A; viewing athletic cup 200 looking straight down from above in FIG. 2B; viewing athletic cup 200 straight on from an equal plane with perineal bridge 205 in the foreground in FIG. 2C; and viewing athletic cup 200 looking straight at one side from an equal plane with peripheral lip side 212 in the foreground in FIG. 2D.

Athletic cup 200 has the following elements: Looking into athletic cup 200 from underneath, as in FIG. 2A, interior surface 220 is shown with vent holes 215. The interior of athletic cup 200 is of a concave shape formed into concave interior structure 230. Looking at the surface of athletic cup 200 from above, as in FIG. 2B, vent holes 215 are visible as is exterior surface 225 in the shape of convex structure 235. Near the lower base of athletic cup 200 is perineal bridge 205 which spans or "bridges" the opening in lower peripheral lip 213. Peripheral lip 210 surrounds the majority of athletic cup 200 in a shape similar to that of a horseshoe. Peripheral side 211, a lower portion of peripheral lip 210, begins just before perineal bridge 205 following the circumference of athletic cup 200 along one side to the upper portion of athletic cup 200. Peripheral side 211 transitions into upper peripheral lip 214, also a portion of the same peripheral lip 210, curving over and around the circumference of the upper portion of athletic cup 200. Upper peripheral lip 214 transitions into peripheral lip side 212, an upper side portion of peripheral lip 210 opposite of peripheral lip side 212, following the circumference of one side of athletic cup 200 ending just after perineal bridge 205. Located at the bottom of athletic cup 200 is an opening in lower peripheral lip 213, separated by perineal bridge 205. The portion of athletic cup 200 where opening in lower peripheral lip 213 is shown is alternatively referred to as anatomically inferior portion 255 or lower portion 255.

In one embodiment, the main body of athletic cup 200 is made up of convex structure 235 on the outside, covered by exterior surface 225, and by concave interior structure 230 and lined by (e.g. covered on the inside) interior surface 220. In this embodiment, convex structure 235 provides structural strength and rigidity to resist collapse upon impact from a foreign object, such as an impact from a baseball, hockey puck, or hockey stick, and further to resist collapse due to blows from athletic opponents, such as a kick from a martial arts fighter or a punch from a boxing prize fighter.

In a particular embodiment, convex structure 235 further aids in providing a desirable concave shape for concave interior structure 230 on the interior of athletic cup 200. In this embodiment, concave interior structure 230 rises out and away from a wearer to a spherical high point substantially in the center of athletic cup 200. Concave interior structure 230, when worn by a male, protrudes out away from the male's penis and scrotal sac resulting in interior surface 220 supported out in front of a male wearer. Stated differently, interior surface 220 covers or is positioned over a penis, scrotum, and testicles of a wearer. Upon impact to athletic cup 200, concave interior structure 230 in conjunction with convex structure 235 helps prevent interior surface 220 from collapsing onto and coming in contact with the male's penis and scrotum, thus preventing soft tissue injury to the penis or testicles or both.

In one embodiment, concave interior structure 230 and convex structure 235 on the exterior of athletic cup 200 form a resilient semi-rigid body structure of athletic cup 200. In a particular embodiment, structural body 250 of athletic cup 200, including concave interior structure 230 and convex structure 235, is made of synthetic materials such as plastics and polymers. In another embodiment, structural body 250 is made of layers of woven synthetic materials. Synthetic materials and their various properties are well known in the arts and will not be discussed further, except for the particular properties that may be desirable such as flexibility, smoothness, rigidity, and resiliency. For example, a resilient material causes a manufactured object made of such material to spring back or rebound to its originally manufactured shape, form, or position after being bent, compressed, or stretched. A rigid synthetic material would cause a manufactured object to resist a change of its originally manufactured shape whether by compression, torsion, bending, or stretching. A combination of such materials would yield a manufactured object having both resilient and rigid properties, resulting in a semi-rigid object.

Different manufacturing techniques are of course available to form structural body 250 and other elements of athletic cup 200. For example, in one embodiment, high-density high strength foam is injected into a form. In another embodiment, plastics are cast in a mold. In yet another embodiment, layers of carbon fiber, fiberglass, or other synthetic weaves are applied one by one onto a shaper and later cut, sanded, and smoothed.

In one embodiment, structural body 250 of athletic cup 200 including concave interior structure 230 and convex structure 235 is of equal thickness, less than ⅜ of an inch. In a particular embodiment, structural body 250 of athletic cup 200 including concave interior structure 230 and convex structure 235 is formed of a single layer of one uniform synthetic material. In an alternative embodiment, structural body 250 of athletic cup 200 including concave interior structure 230 and convex structure 235 is formed of multiple layers of differing synthetic materials having different properties.

Different properties for structural body 250 of athletic cup 200 may be desirable to affect performance attributes relating to, for example, total weight, flexibility and rigidity, resistance to fracture, resistance to collapse, resistance to warping, consistency of performance and attributes at varying temperatures, smoothness, and so on. For example, in one embodiment, a smooth interior surface 220 is desirable to enhance comfort should the wearer's penis or scrotum rub against interior surface 220 of athletic cup 200. A synthetic material that enhances the smoothness of interior surface 220 is thus incorporated within the innermost layer exposed to the wearer's genital skin.

In another embodiment, a rough dimpled surface is desired to enhance the athletic cup's tendency to stay properly positioned within a supporting jock strap. A synthetic material that enhances the roughness of exterior surface 225 is thus incorporated within the outermost layer exposed to interior of a jock strap. Additionally, a manufacturing process that enhances a dimpling effect can be incorporated to create the desired effect to exterior surface 225. In one embodiment, a rough dimpled exterior surface 225 is mated with a smooth interior surface 220.

Other attributes can be enhanced through the proper application of manufacturing processes and use of synthetic materials. For example, in one embodiment, structural body 250 of athletic cup 200 is desired to be pliable, increasing the comfort to the wearer by allowing the athletic cup to give and conform better, but provide less resistance to collapse. Multiple layers can again be incorporated allowing the outer sides of athletic cup 200 to have more give via pliable synthetic materials, while the center portion of athletic cup 200 is a more resilient or rigid material. Numerous combinations and permutations of synthetic material and layer combinations are of course possible to reach the desired effect using well-known materials and their properties as recognized by those having skill in the art.

Vent holes 215 are placed into structural body 250 for the purpose of ventilating warm moist air trapped within the athletic cup when worn. Three such vent holes 215 are depicted in FIGS. 2A-2D, but obviously more or fewer holes may be used.

When a wearer of athletic cup 200 receives a blow or an impact in the groin area, the force of the impact will be received at structural body 250. In one embodiment, structural body 250 absorbs at least a portion of the impact and dissipates the shock of the force through a combination of resilient and semi-rigid materials. In a particular embodiment, at least a portion of the impact is not dissipated by structural body 250 and must therefore be transferred. In this embodiment, the force of the impact is deflected away from the centermost portion of structural body 250. Structural body 250 resists collapsing onto the penis and scrotum of the wearer, or resists fracturing and breaking inward onto the penis and scrotum of the wearer, or both.

In a particular embodiment, at least a portion of the force associated with an impact to structural body 250 of athletic cup 200 is transferred to the circumference of athletic cup 200 into the body of the wearer via peripheral lip 210. In particular, the force is transitioned from structural body 250 into peripheral lip 210, and then transitioned again into the body of the wearer, wherever peripheral lip 210 of athletic cup 200 contacts the wearer's skin. In one embodiment, peripheral lip 210 of athletic cup 200 is positioned over the pelvic bone of the wearer, and the force is thus transferred into the wearer's pelvic bone through the wearer's skin, and away from the wearer's soft tissue including the penis, scrotal sac, testicles, and perineum. In this embodiment, peripheral lip 210 is not touching the skin covering the perineal nerves of the wearer, nor is the peripheral lip 210 positioned over the wearer's perineum.

In a particular embodiment, there is an opening in the lower peripheral lip (213), leaving a gap or a space at the bottom portion of athletic cup 200 in closest proximity to the wearer's perineum. In one embodiment, the absence of a lower peripheral lip of athletic cup 200 causes all forces transitioned to peripheral lip 210 from structural body 250 to dissipate at, or be redirected from, the opening in the lower peripheral lip (213) as there is no solid matter with which to transition the forces through to a perineum of a wearer.

Peripheral lip 210 is connected with structural body 250 around the majority of the circumference of structural body 250, save for the bottom portion where the opening in the lower peripheral lip (213) is located. In one embodiment peripheral lip 210 is a single piece of synthetic material attached at an outer boundary of structural body 250. In this embodiment, an upper portion of peripheral lip 210 is located at the upper portion of structural body 250, depicted for example in FIG. 2B as upper peripheral lip 214. Similarly, two side portions of peripheral lip 210 are located at each of two opposite sides of structural body 250, depicted for example in FIG. 2B as peripheral lip side 211 and peripheral lip side 212. As mentioned above, a lower portion of peripheral lip 210 is missing or "open" or "gapped," as depicted for example in FIG. 2B as opening in lower peripheral lip 213.

Similar to structural body 250, concave interior structure 230, and convex structure 235, peripheral lip 210 can be manufactured and created from a large variety of materials. In one embodiment, peripheral lip 210 is made of an identical material to that of structural body 250. In a similar embodiment, peripheral lip 250 is manufactured in the same process as structural body 250 forming a single unitary piece including structural body 250 and peripheral lip 210. In an alternative embodiment, materials chosen for soft cushion-like properties are used to construct peripheral lip 210. In yet another embodiment, materials having a property that resists the spread of live bacteria is used to decrease odors associated with physical activities. In another embodiment, materials are chosen for their tendency to "stick" or stay put against human skin, and peripheral lip 210 is constructed of such material.

Located at the bottom portion of athletic cup 200 is perineal bridge 205 as depicted in FIGS. 2A-2D. This area of athletic cup 200, the lower portion, is in closest proximity to the perineum of a wearer. When athletic cup 200 is placed on planar surface, such as that depicted in FIG. 2C, perineal bridge 205 can be seen spanning or "bridging" the opening in lower peripheral lip 213. In one embodiment, perineal bridge 205 raises up and away from a planar surface as depicted in FIG. 2C.

In another embodiment, perineal bridge 205 protrudes out and away from a wearer's perineum in the shape of an arched bridge. In yet another embodiment, perineal bridge 205 is shaped as a second convex shaped structure protruding outwards in the same direction as a first convex structure 235, but protruding to only a portion of the same height. Perineal bridge 205 may also be described as creating an "air gap" between the perineum of a wearer and an arc of perineal bridge 205. Similarly, when athletic cup 200 is worn, perineal bridge 205 creates a "void" or "space" between the perineum of a wearer and perineal bridge 205. This air gap prevents the perineal area artery, nerves, veins from being compressed between athletic cup 200 and the pubis of a wearer.

In one embodiment, perineal bridge 205 protects the wearer from sustaining soft tissue blunt trauma injuries to the perineum by directing impact forces received at athletic cup 200 away from the wearer's soft tissue and perineum. In an alternative embodiment forces received at athletic cup 205 associated with an impact are partially transferred to perineal bridge 205 at which point the forces are dissipated by perineal bridge 205 materials and shape, deflected and redirected into peripheral lip 210, returned to structural body 250, or some combination thereof. For example, in one embodiment flexible, pliable, and/or soft materials are used to create a perineal bridge 205 at anatomically inferior portion 255 of athletic cup 200. In this embodiment, perineal bridge 205 rests on the perineum of a wearer, touching the skin of the wearer. When an impact force is received at athletic cup 200, a portion of the impact force is transferred to perineal bridge 205 and dissipated by the non-rigid materials. In this embodiment, the remaining force transferred to the perineum of the wearer is insufficient to damage the soft tissues of the perineum.

In one embodiment, perineal bridge 205 is shaped as an arc. In another embodiment, perineal bridge 205 is shaped as a flat strip. In a particular embodiment, perineal bridge 205 is connected at either end to a lower portion of peripheral lip side 211, a lower portion of peripheral lip side 212, or both. In an alternative embodiment, a portion of peripheral lip sides 211-212 extend beyond perineal bridge 205, as depicted for example in FIG. 2A. In another embodiment, peripheral lip sides 211-212 terminate prior to the end of perineal bridge 205, thus leaving a portion of perineal bridge 205 extending past the lowest portions of peripheral lip 210. In yet another embodiment, peripheral lip sides 211-212 and perineal bridge 205 terminate flush at a lower portion of athletic cup 200.

In a particular embodiment, perineal bridge 205 is shaped as an arch having a fully closed lower peripheral lip at anatomically inferior portion 255. The closed lower peripheral lip rests on the skin of a wearer's perineum, but is constructed of flexible, soft, or pliable foam like materials so as to prevent continuous pressure from being exerted onto the perineum or blunt traumas and micro-trauma received at athletic cup 200 from transferring forces to the perineum through the closed lower peripheral lip. In this embodiment, although the closed lower peripheral lip may be in contact with the wearer's perineum, the materials used are such that movement by the wearer, pressures received at athletic cup 200, or impact forces received at athletic cup 200 do not substantially transfer to the wearer's perineum in contact with the closed lower peripheral lip, the forces being dissipated through the flexible, soft, or pliable foam like materials and thus prevent pressure or impact related injury to the perineum.

Similar to structural body 250 and peripheral lip 210, perineal bridge 205 may be constructed of a variety of synthetic materials. In other embodiments, natural materials may also be desired and implemented in place of synthetics. For example, in one embodiment, perineal bridge 205 is manufactured from natural cowhide leather and installed between peripheral lip sides 211-212. It may be desirable to construct perineal bridge 205 of soft or flexible materials to increase comfort to a wearer and decrease the risk of injury should perineal bridge 205 impact a wearer's perineum. For example, in one embodiment, a synthetic and non-porous rubber-like material is used. Should the rubber-like synthetic material forcefully strike the perineum of a wearer or transmit force to the perineum of a wearer, very little force will be received at the perineum of the wearer and thus, the likelihood of a soft issue trauma to the perineum is greatly reduced. In this embodiment, the non-porous rubber-like material further helps prevent the spread of live bacteria and thus is more sanitary and harbors less odor.

In one embodiment, perineal bridge 205 is constructed from an identical material as structural body 250. In this embodiment, structural body 250 is semi-rigid, and therefore capable of transferring possibly injurious forces onto the perineum. In this embodiment, perineal bridge 205 is arched out and away from the perineum of a wearer with a sufficient distance to prevent any point of perineal bridge 205 from deflecting or collapsing to the point of causing contact with the wearer's perineum. In a particular embodiment, a vertical radius of 1" (one inch) is sufficient to prevent perineal bridge 205 from coming in contact with the perineum of a wearer upon impact to athletic cup 200. In alternative embodiments, a more rigid structural body 250 and perineal bridge 205 are employed and a lesser vertical radius may be used.

In some embodiments, perineal bridge 205 may be an opening or void shaped into the material of structural body 250 at a lower portion in closest proximity to a wearer's perineum. For example, in one embodiment a semi-rigid athletic cup 200 is molded and the structural body has a 0.25" to 1.0" (one quarter to one inch) tall void in place of perineal bridge 205 and a width equal to the distance between the lower portions of peripheral lip sides 211-212. In one embodiment, peripheral lip 210 surrounds the entire perimeter of athletic cup 200, including anatomically inferior portion 255, but is molded in a retracted or inverted fashion creating an arc shaped void at anatomically inferior portion 255 of athletic cup 200 to be positioned over the perineum of a wearer. In an alternative embodiment, a cushion-like foam lip is adhered to the entire perimeter of peripheral lip 210 and the cushion-like foam lip follows the contour of the peripheral lip out and away from the perineal area of a wearer creating either a gap above the perineum or a soft cushioned segment at the anatomically inferior portion 255 of athletic cup 200 capable of dissipating forces received.

While the invention has been described in terms of several embodiments, those skilled in the art will recognize that the invention is not limited to the embodiments described, but can be practiced with modification and alteration within the spirit and scope of the appended claims. The description is thus to be regarded as illustrative instead of limiting. Moreover, many of the embodiments disclosed make reference to a single perineal bridge 205 and structural body 250, however, multiple such components may be joined within a single athletic cup 200 creating a bridging, spanning, spacing, or gapping effect in the area of the perineum, thus redirecting forces away from soft tissue of the wearer in accordance with the present invention. Moreover, other structural body 250 shapes known in the art may be used in accordance with the present invention, such as structural body shapes that conform to or contour the genitals, and wider, narrower, or elongated structural body 250 shapes.

What is claimed is:

1. An athletic cup comprising:

a convex structure to direct a force associated with an impact to the athletic cup to a pelvic bone of a wearer and away from soft tissue of the wearer;

an arc creating an opening, an air gap, or a space at a lowermost anatomically inferior portion of the athletic cup relative to placement of the athletic cup over a groin area of the wearer, the arc to be positioned relative to a perineal region of the wearer to prevent the force associated with the impact to the athletic cup from impacting or compressing the perineal region of the wearer between the athletic cup and the pubis of the wearer; and wherein the arc creating the opening, the air gap, or the space at the lowermost anatomically inferior portion of the athletic cup creates the opening, the air gap, or the space at an outermost edge portion to bridge opposing peripheral lip sides adjacent to the opening, the air gap, or the space created in the outermost edge portion.

2. The athletic cup of claim 1, wherein the athletic cup comprises a peripheral lip circumventing an entire terminal edge of the athletic cup except for where the arc creates the opening, the air gap, or the space at the outermost edge portion to bridge the opposing peripheral lip sides adjacent to the opening, the air gap, or the space created in the outermost edge portion, thus forming an absence of a lower peripheral lip of the athletic cup leaving only an upper peripheral lip at the uppermost anatomically superior portion of the athletic cup and two peripheral lip sides of the athletic cup, the first peripheral lip side located at a leftmost left lateral portion of the athletic cup and the second peripheral lip side located at a rightmost right lateral portion of the athletic cup, and wherein the absence of the lower peripheral lip of the athletic cup causes all forces transitioned to the peripheral lip to dissipate at, or be redirected from, the opening, gap, or space forming the absence of the lower peripheral lip of the athletic cup, as there is no solid matter located at the lowermost anatomically inferior portion of the athletic cup with which to transition the forces through to the perineal region of the wearer.

3. The athletic cup of claim 1, wherein the soft tissue of the wearer comprises:

a penis, a scrotal sac and testes; and the perineal region of the wearer, wherein the perineal region comprises:

a plurality of nerves beneath a perineal area of the wearer, an artery beneath the perineal area of the wearer, a urethra beneath the perineal area of the wearer, and a plurality of veins beneath the perineal area of the wearer.

4. The athletic cup of claim 1, wherein the arc creating the opening, the air gap, or the space at the lowermost anatomically inferior portion of the athletic cup creates the opening, the air gap, or the space at an outermost edge portion to bridge opposing peripheral lip sides adjacent to the opening, the air gap, or the space created in the outermost edge portion comprises an arc shaped perineal bridge to be positioned over the perineal region of the wearer.

5. The athletic cup of claim 4, wherein the arc shaped perineal bridge creates a gap between the arc of the perineal bridge and the perineal region of the wearer.

6. The athletic cup of claim 1, wherein the arc creating the opening, the air gap, or the space at the lowermost anatomically inferior portion of the athletic cup comprises an open void at the lower anatomically inferior portion of the athletic cup, the open void to be positioned over the perineal region of the wearer.

7. The athletic cup of claim 1, wherein the convex structure comprises an interior surface to be positioned over a penis and a scrotum of the wearer.

8. The athletic cup of claim 1, wherein the convex structure comprises a synthetic resilient material, the synthetic resilient material to resist collapsing from the force associated with the impact.

9. The athletic cup of claim 1, wherein the convex structure comprises a synthetic rigid material, the synthetic rigid material to resist fracturing from the force associated with the impact.

10. The athletic cup of claim 1, further comprising:

a peripheral lip connected with the convex structure and positioned around a first side, a top side, and a second side of the convex structure, wherein the peripheral lip comprises a first end at a lower portion of the first side, a second end at a lower portion of the second side, and a cushioning material to absorb a portion of the force to be directed to the pelvic bone of the wearer without trapping the soft tissue against a pubis of the wearer.

11. An athletic cup comprising:

a convex structure comprising means for directing an impact force received at the athletic cup to a pelvic bone of a wearer and away from soft tissue of the wearer;

an arc creating an opening, an air gap, or a space at a lowermost anatomically inferior portion of the athletic cup relative to placement of the athletic cup over a groin area of the wearer, the arc to be positioned substantially over a perineal region of the wearer, the arc having means for preventing the impact force received at the athletic cup from impacting or compressing the perineal region of the wearer between the athletic cup and the pubis of the wearer; and wherein the arc creating the opening, the air gap, or the space at the lowermost anatomically inferior portion of the athletic cup creates the opening, the air gap, or the space at an outermost edge portion to bridge opposing peripheral lip sides adjacent to the opening, the air gap, or the space created in the outermost edge portion.

12. The athletic cup of claim 11, further comprising:

a peripheral lip for receiving the force from the convex structure, wherein the peripheral lip comprises means for absorbing at least a first portion of the force, and means for transferring a second portion of the force to a pubic bone of the wearer and away from the soft tissue of the wearer.

13. The athletic cup of claim 12, wherein transferring the second portion of the force to the pubic bone of the wearer and away from the soft tissue of the wearer comprises:

means for transferring the second portion of the force into skin of the wearer covering the pubic bone of the wearer and away from the soft tissue of the wearer including a penis of the wearer, testicles of the wearer, and the perineal region of the wearer; and means for preventing the second portion of the force from compressing the perineal region of the wearer against a pubis of the wearer.

14. An athletic cup comprising:

a convex structure to direct a force associated with an impact to the athletic cup to a pelvic bone of a wearer and away from soft tissue of the wearer;

a perineal bridge at an anatomically inferior portion of the athletic cup to be positioned substantially over a perineal region of the wearer and direct the force associated with an impact to the athletic cup away from the perineal region of the wearer; and wherein the perineal bridge comprises:

a flat strip of pliable material at the anatomically inferior portion of the cup to rest substantially on or over the perineal region of the wearer or a curved arc shaped strip of pliable material at the anatomically inferior portion of the cup to curve away from the perineal region of the wearer; and wherein the pliable material comprises insufficient rigidity to transfer a substantial portion of the force associated with the impact to the athletic cup to the perineal region of the wearer.

15. The athletic cup of claim 14, wherein the perineal bridge comprises a convex shape, and wherein the convex shape of the perineal bridge is raised in a direction away from the perineum of the wearer.

16. The athletic cup of claim 14, further comprising:

an arch shaped peripheral lip connected with the convex structure at an outer boundary of the convex structure, wherein the arch shaped peripheral lip comprises a space between a first end point and a second end point, the space positioned at the lower portion of the cup-shaped structure, and wherein the flat strip of pliable material or the curved arc shaped strip of pliable material is located in the space between the first end point and the second end point of the arch shaped peripheral lip to form the perineal bridge.

17. The athletic cup of claim 14, further comprising:

a cushioned peripheral lip attached to a circumference of the convex structure, wherein the cushioned peripheral lip comprises a gap located at the lower portion of the convex structure, and wherein the flat strip of pliable material or the curved arc shaped strip of pliable material is located in the gap located at the lower portion of the convex structure to form the perineal bridge.

* * * * *